United States Patent [19]

Lala

[11] 4,282,805

[45] Aug. 11, 1981

[54] DRIVE FOR PRINTING ELONGATED ARTICLES

[75] Inventor: Louis A. Lala, Cook County, Ill.

[73] Assignee: American Screen Printing Equipment Company, Chicago, Ill.

[21] Appl. No.: 40,492

[22] Filed: May 21, 1979

[51] Int. Cl.[3] ..... B41F 17/22; B41L 13/18

[52] U.S. Cl. ..... 101/38 R; 101/124; 101/126; 74/110

[58] Field of Search ..... 101/124, 126, 123, 115, 101/38 R, 38 A, 7; 74/110

[56] References Cited

U.S. PATENT DOCUMENTS

| | | | |
|---|---|---|---|
| 1,538,716 | 5/1925 | Martin | 74/110 X |
| 2,540,554 | 2/1951 | Shurley | 101/124 X |
| 3,109,365 | 11/1963 | Karlyn | 101/124 |
| 3,139,824 | 7/1964 | Derrickson | 101/124 |
| 3,260,194 | 7/1966 | Karlyn | 101/126 X |
| 3,277,816 | 11/1966 | Olson | 101/38 R |

FOREIGN PATENT DOCUMENTS

| | | | |
|---|---|---|---|
| 21329 | 2/1935 | Australia | 101/124 |

*Primary Examiner*—Edgar S. Burr
*Assistant Examiner*—C. A. Pearson
*Attorney, Agent, or Firm*—Robert E. Wagner

[57] ABSTRACT

A screen drive assembly is described for use with screen printing presses for facilitating the printing of elongated articles. In the printing press of the subject invention, the screen is driven towards and away from the press over the article to be printed by a unique drive which converts the reciprocal motion of the drive carriage between the end supports to a reciprocal motion in a perpendicular direction. The article is mounted for printing with an axis of rotation parallel to the primary support shafts, and may be substantially freely rotated, in response to the passage of the screen over the article during the printing cycle.

8 Claims, 7 Drawing Figures

DRIVE FOR PRINTING ELONGATED ARTICLES

BACKGROUND OF THE INVENTION

This invention relates to screen printing presses in general and, in particular, to a method and apparatus for printing elongated articles.

Screen printing is widely used for printing objects of revolution such as bottles, cans, cones and the like. Various types of screen printers are available to accomplish the printing of three-dimensional objects and many, such as that taught in U.S. Pat. No. 3,090,300, utilize an object holder or nest extending outwardly in a perpendicular fashion from the printing press. In such screen printers the screen can be held stationary and the squeegee moved relative to both the screen and the object holder to force the ink through the screen for printing flat objects, or the squeegee may be held stationary against the screen and the screen and peripheral surface of the object may be moved laterally, as when printing objects of circular dimensions. For objects of revolution, e.g., circular items, these elements are coordinated for movement in timed relationship to each other during the printing cycle. Such a timed relationship usually requires that the screen and peripheral surface of the object move at identical linear speeds.

In the past, when printing elongated cylindrical articles such as ski poles, pool cues, thermometers and the like, the article was mounted for rotation on a horizontal holder supported on a cantilever tooling post perpendicular to the primary support shafts of the press while the screen moved laterally across it. In printing such elongated objects, difficulties presented themselves in the feeding of the articles to the holder for printing. These difficulties may be attributed chiefly to the awkward size of the article. For instance, a right-handed worker would have difficulties feeding from the right side of the workholder. Further, the positioning and adjustment of an elongated article must necessarily be made from the side, as the article will preclude the operator from standing directly in front of the workholder, thus making registration and the like a difficult task.

SUMMARY OF THE INVENTION

Therefore, an object of the subject invention is an attachment for use with the screen printer which will allow the efficient and accurate feeding and registration of an elongated article for printing.

Another object of the subject invention is an attachment for use with screen printers which allows the printing of elongated objects held parallel with the primary support shafts.

Yet another object of the subject invention is an attachment for a screen printer which will allow the printing of elongated articles without requiring the squeegee to be supported at great distances from the primary support shaft, thereby providing for stronger and more stable support for the squeegee.

These and other objects are attained in accordance with the present invention wherein there is provided an attachment for printing elongated articles having cylindrical or polygonal cross sections. The article is held on a workholder for substantially free rotation about its longitudinal axis. The workholder is supported on one or more tooling posts extending outwardly and perpendicular to the press, and is mounted parallel to the primary support shafts. The length and height of the workholder may be adjusted for the support of articles of different lengths and sizes. A squeegee is supported over the object to be printed parallel to the primary support shafts and directly over the longitudinal axis of the article to be printed. Should it be desired to print over an extended article length, an equally extended squeegee length may be supported by the provision of two or more mounting means on the primary support shafts.

The squeegees are secured on the mounting means at the desired distance from the printing press for positioning directly over the central axis of the article to be printed. The article is then positioned in the workholder and the height of the squeegee vertically adjusted so that tension is maintained on the article to be printed to the screen by the squeegee. Ink is poured onto the screen and by reciprocating the screen towards and away from the printing press, ink is pushed through the screen onto the article in the pattern or design desired.

The screen is reciprocated by connection to a drive carriage which is driven laterally on a drive shaft by a Geneva cam drive or other suitable drive structure. Mounted on the front of the drive carriage is a drive plate. The plate carries a horizontal drive rod secured at opposite ends of the plate. One end of the drive rod is secured adjacent the plate, while the other end is secured at a point spaced from the plate, thereby causing the drive rod to extend angularly outward from the plate. An attachment block is slidingly engaged with the drive rod for lateral movement along the drive rod. The screen is mounted on linkage members which are supported by the primary support shafts of the printing press for lateral movement towards and away from the printing press, while resisting movement in a direction parallel to the primary support shafts. Thus, on the reciprocal lateral movement of the drive carriage along the shaft, the attachment block and the screen to which it is attached will move in a direction perpendicular to the drive plate, thereby generating a reciprocal action of the screen towards and away from the primary support shafts. Such movement of the screen is in conjunction with the print and flood modes of the press, so that when the screen moves in one direction it rotates the article. The squeegee, in contact with the screen, pushes ink through the screen to print on the article, all in the print mode; when the screen moves in the opposite direction, the screen moves upward off the article, and the squeegee is raised off the screen, in the flood mode.

DESCRIPTION OF THE DRAWINGS

Further objects of the invention, together with additional features contributing thereto and advantages accruing therefrom will be apparent from the following description of one embodiment of the invention when read in conjunction with the accompanying drawings wherein:

Referring now to FIG. 1, there is shown one embodiment of the screen printing press 10 converted according to the subject invention for printing on elongated objects. While the subject invention may be adapted for use with practically all universal printers, the actual printing press shown as being converted for use with the subject invention is of the type described in either of U.S. Pat. No. 4,111,118 or U.S. Pat. No. 4,184,427. As shown, the screen printer 10 includes a frame or bottom support 18 on which are secured spaced upright supports 16. Horizontal primary support shafts 12, including drive support shaft 13 are mounted between the upright supports 16 in parallel.

THE SQUEEGEE ASSEMBLY

Figure 1:
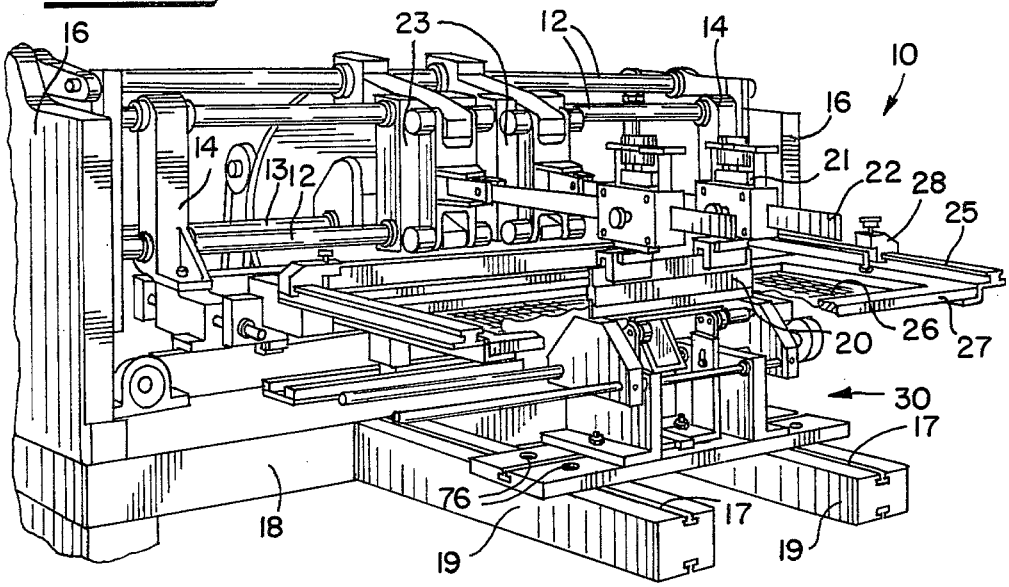
FIG. 1 is a perspective view of the screen printing press attachment of the subject invention with the screen partially cut away to show the workholder beneath.
Figure 2:
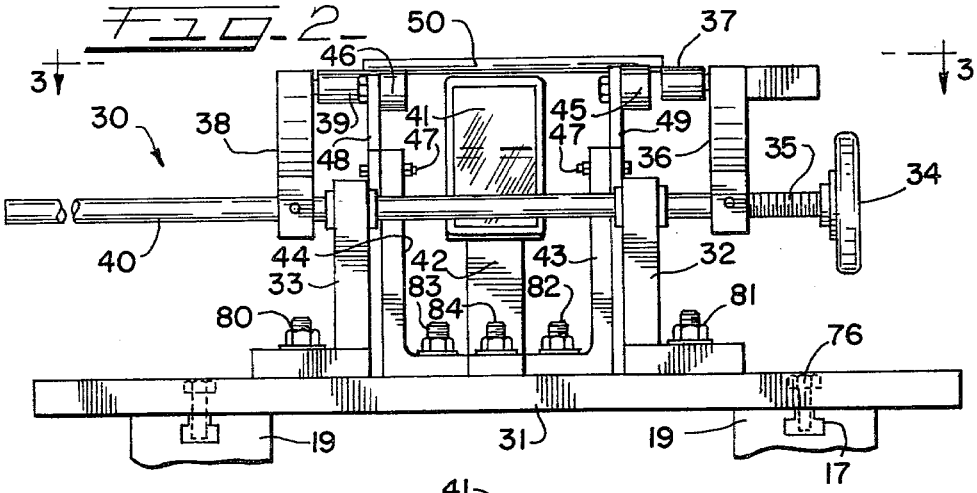
FIG. 2 is a front plan view of the workholder of the subject invention.

A squeegee 20 is mounted over a screen 26 for contact with the screen 26 during the printing operation. The squeegee 20 is lifted off the screen 26 during the flood mode by squeegee linkage support members 23. The squeegee assembly is attached to the squeegee support mounts 23 by rods or bars 22. The squeegee 20 itself depends from these bars 22 by means of a support mechanism which allows the vertical adjustment of the squeegee blade 20 for the exertion of a desired amount of tension by the blade on the screen 26. As the manner of support of the squeegee is taught in greater detail in U.S. Pat. No. 4,184,427, further discussion of such features, as it relates to the support of a standard size squeegee by a single support means, is not considered necessary. Because of the length of the squeegee blade 20, which is necessary to print on the elongated articles, two or more squeegee support mounts may be utilized, as shown in FIG. 1. Such an arrangement gives greater stability and rigidity to the squeegee blade 20 during the printing operation. In this manner, practically any length of squeegee blade may be utilized through the addition of squeegee support assemblies, comprising a squeegee support 21 adjustably mounted on the rod 22 which is connected in cantilever fashion to the squeegee linkage support member 23.

The screen 26 may itself be elongated to accommodate greater lengths of articles being printed and is tensioned over a frame 27, which is secured in a screen frame support 25 by clamps 28. The screen frame support 25 is supported by the primary support shafts 12 through screen support linkages 14.

THE WORKHOLDER ASSEMBLY

A workholder assembly 30 is supported on tooling posts 19 so that the longitudinal axis of an article secured by it for printing is parallel with the primary support shafts. Suitable fastening means 76 secured into groove 17 of the tooling post 19 allows the workholder mount 31 to be positioned any desirable distance from the printing press and then secured in that position by the tightening of the fastening means 76 in the grooves 17.

The article to be printed 50, is mounted on two pairs of rollers 45 and 46. Roller pairs 45 and 46 are adjustably mounted on roller supports 43 and 44 respectively. The rollers may each be vertically positioned on the roller supports 43 and 44 to accommodate the different diameters of articles to be printed. Such an adjustment may be allowed by securing roller mounts 49 and 48 to the supports 43 and 44 respectively by means of a nut and bolt 47 within a vertical slot (not shown) or other suitable means.

Figure 3:
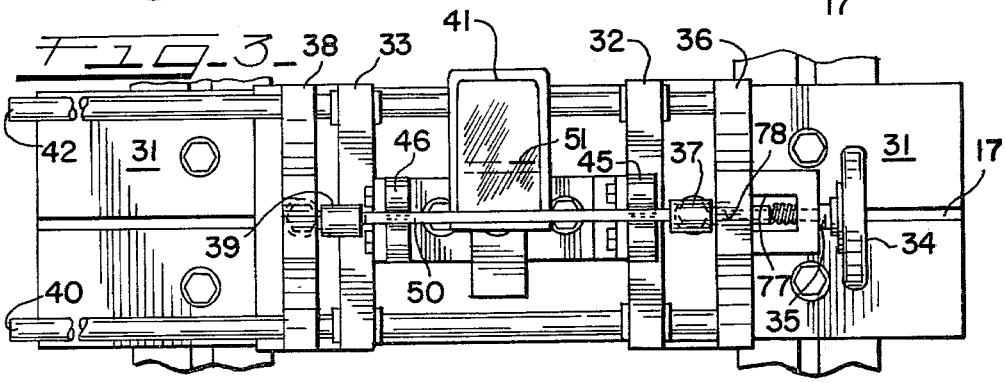
FIG. 3 is a top plan view of the workholder of the subject invention taken along the line 3—3 of FIG. 2.
Figure 4:
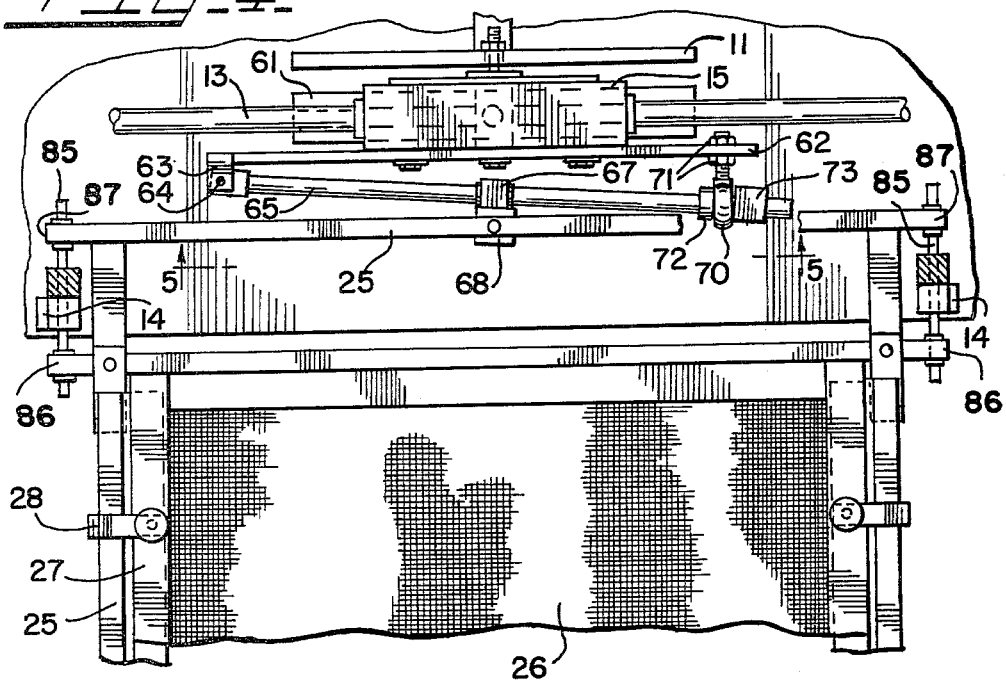
FIG. 4 is a partial top plan view of the subject invention showing the drive means and the connection of the drive means to the screen.

The article 50 is positioned on roller pairs 45 and 46 and the registration mark on the article 50 is visually aligned with a mark 51 placed on mirror 41 by the operator. The mark 51 and the angle of mirror 41 are each preset by the operator so that the visual alignment of the respective marks will place the article in the correct position and registration for printing. Once the article is correctly positioned and registered, the article 50 is secured in that position by clamps 37 and 39. Clamp 39 is attached to clamp mount 38 which rides on support rods 40 and 42 (FIG. 3). Clamp mount 38 is secured in a desired position by set screws or the like on rods 40 and 42, which position is predetermined at the start of a printing run of a particular article through initial determination of the correct position of the article for printing as will be described. Once having set the position of clamp mount 38, it need not be disturbed throughout the printing run of that article.

Clamp head 37 is attached to clamp mount 36 which is rigidly mounted to one end of support rods 40 and 42. Clamp head 37 is supported on a shaft 77 which extends through opening 78 in clamp mount 36. The clamp head 37 and shaft 77 are spring loaded within opening 78 for the exertion of a slight continuous force against the end of the article being printed on while allowing the clamp head to be retracted for the easy removal of the article 50 after the printing operation. As such, the object may be retained in a precisely registered position while a substantially free rotation of the object is allowed. Of course, any other manner of providing such a bias while allowing substantially free rotation of the clamp head 37 may be used.

The exact lateral positioning of the article 50 may be accomplished by the movement of the clamp supports 36 and 38 relative to roller supports 32 and 33. A threaded shaft is rotatably secured in roller support 32 at one end and threadedly engaged with clamp support 36 at its midsection. Thus, rotation of the threaded shaft 35 by means of the knob or handle 34 will incrementally move both clamp support 36 and 38 and thus clamp head 37 and 39 to the right or to the left as desired. Such movement can adjustably position or "fine tune" the article 50 as desired for alignment of a registration mark on the article 50 with the mark 51 on the mirror 41, allowing for a precise registration of the article prior to printing.

For a greater positioning capability, the entire assembly may be moved laterally on the workholder 41 by loosening bolts 80 and 81, securing the rod supports 32 and 33 respectively to the workholder mount 31. In addition, bolts 82 and 83, securing the roller support mounts 43 and 44 respectively, are loosened. Each support mount 32, 33 43 and 44 is then adjusted on the workholder mount 31 in the position desired and the respective bolts tightened to secure each support mount in its new position. The mirror 41 may be adjusted in a desired spot for coordination with the registration mark on the article to be printed by loosening bolt 84, adjusting the mirror's position laterally, and tightening.

THE SCREEN DRIVE ASSEMBLY

In the printing of circular articles or three-dimensional articles of a circular cross section, the article is generally rotated or rocked while the screen is moved laterally. In prior art printing presses, this is generally accomplished by placing the article on a holder assembly which is driven in a rocking motion, such as by a mechanism such as is taught in U.S. Pat. No. 3,090,300 to Dubuit, U.S. Pat. No. 3,139,824 to Derrickson, U.S. Pat. No. 4,111,118 to Green, et al., and U.S. Pat. No. 4,184,427 to Bubley, et al. In each of the above-described drive assemblies, the object is rotated or rocked to present its peripheral surface to the screen at the precise linear speed and in the same direction as the movement of the screen.

In the subject invention, the screen is moved toward and away from the screen printing machine rather than left to right as conventionally done. Since the article 50 to be printed is mounted on roller pairs 45 and 46 for substantially free rotation as described above, the object 50 is rotated by the action of the screen as it contacts and passes over the object. Identical linear speeds of the screen and the peripheral surface of the object 50 are attained because the free rotation of the object allows a precise following rotation of the object in response to the movement of the screen over it.

As stated above, screen 26 is mounted for reciprocal movement toward and away from the printing press. The screen frame mount 25 has a pair of spaced ears 86 and 86 extending outward from an inner end portion of frame mount 25. The screen support linkage 14 extends between ears 86 and 87, and encloses shaft 85 in a sliding relationship. The shaft 85 extends through and is secured in each of the ears 86 and 87. Each side of the screen frame mount 25 is slidably secured and supported in this fashion, thereby allowing great stability, coupled with a smooth movement of the screen toward and away from the printing press.

The drive means pushing the screen in and out from the printing press comprises a drive carriage 15, which is reciprocated along drive support shaft 13 by a Geneva cam arrangement 11 or the like. This portion of the drive means is further described in U.S. Pat. No. 4,111,118. The drive carriage 15 is thus reciprocated along drive support shaft 13, being stabilized in its movement by guide means 66 within slot means 61 mounted on the support frame 18. Rigidly attached to the drive carriage 15 by means of bolts 74 through slots 75 is a drive plate 62. At one end of the drive plate, a pair of vertically spaced shafts or rods 65 are mounted in hinge block 63. The hinge block 63 is pivotal about pin 64 attached to the end of the drive block 62 for pivotal movement in a horizontal plane. The opposing end or free end portion of one of the rods 65 is mounted to the drive block 62 by eye bolt 70 thereby securing the rods 65 to the drive plate and the drive carriage at a spaced, acute angle. The rod 65 extends through the opening of the eye bolt 70 and is tightly secured by retainer means 72 and 73. The distance of the free end portion of the rod 65 from the drive plate 62 may be adjusted through the appropriate rotation of fasteners 71 on the eye bolt 70. Through this adjustment of the distance of the free end of rod 65 from the drive plate 62, the stroke of the screen over the article may be lengthened or shortened as desired.

The screen frame mount 25 is attached to rods 65 by a sliding means comprising an attachment block 68 having an integral bushing 67 which facilitate the free horizontal movement of block 68 along rods 65. The attachment block 68 is pivotally attached to frame mount 25. In this manner, as the angle of the rods 65 are changed with the adjustment of the distance of the free end portion from the drive plate 62 in the adjustment of the stroke, the attachment block 68 will conform to this angle and always ride on the rods 65 in a free and frictionless manner. By reason of the attachment of the drive plate 62 to the drive carriage 15, the reciprocal action of the drive carriage will move the rods 65 in a similar reciprocal fashion. As the screen frame mount 25 may not move in that direction, such reciprocal action causes the screen frame mount 25 and the screen 26 to move toward and away from the screen printing press, from the following motion of the attachment block 68 and screen frame mount toward and away from the drive plate in its lateral movement on rods 65.

In operation, the article to be printed 50 is measured for length and rod supports 32 and 33 and roller supports 43 and 44 are adjusted in position along the workholder mount 31 to accommodate the appropriate length and diameter of the object. The article is placed on roller pairs 45 and 46 and positioned by rotation of the handle 34 for conformance of the registration mark on the article with the indexing mark 51 on the mirror 41. The height of the squeegee blade 20 is adjusted for bringing an appropriate amount of tension on the screen and the position of the free end of the rod 65 is adjusted to an appropriate distance from the drive plate 62, thereby permitting the appropriate stroke of the screen over the article 50. Having made these adjustments, the operator may stand directly in front of the screen printing press and use either hand to feed the articles from either side of the workholder assembly, regardless of the length of the article which is being printed.

Figure 6:
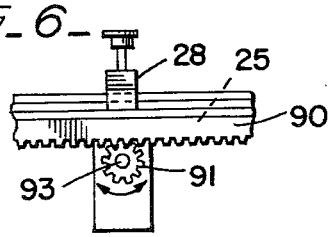
FIG. 6 is a fragmentary side elevation view illustrating a registration mechanism for the object; and, FIG. 7 is a partial cross sectional view of the mechanism shown in FIG. 6.
Figure 7:
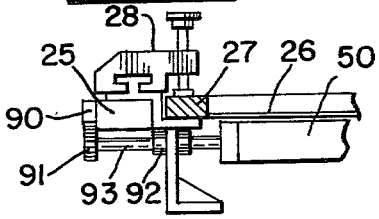
Figure 5:
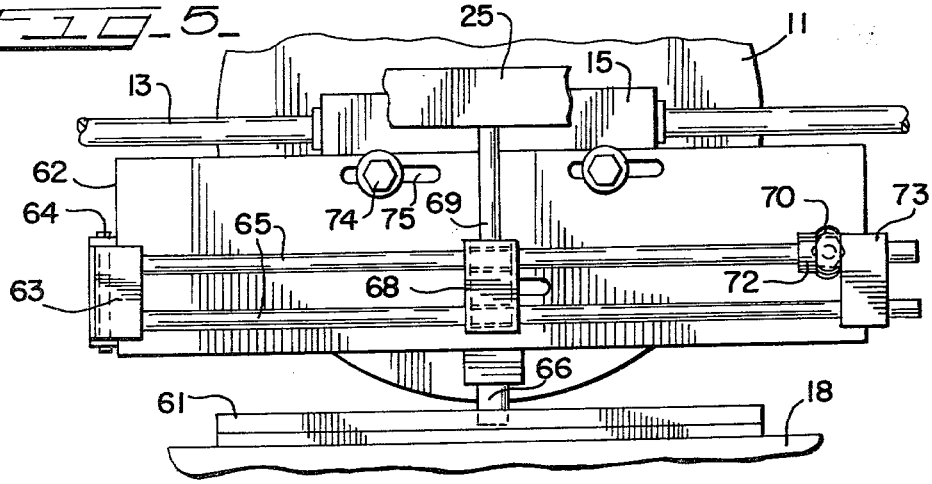
FIG. 5 is a cross sectional view taken along the line 5—5 of FIG. 4 showing the drive plate and drive rod attached thereto.

In one embodiment of the invention, the object to be printed may be registered for multicolor printing by the provision of a rack and pinion assembly supported along the screen arm support 25 as shown in FIGS. 6 and 7. In this embodiment, a rack 90 is secured to the underside of one of the screen supports 25. Clamp 28 secures screen frame 27 and the screen 26 in the same manner as before. Object 50 is attached for following rotation to registration shaft 93, which has a pinion gear 91 on its outer end. A bearing support 92 allows the free travel of shaft 93 through the frame support 25 in its reciprocal motion while retaining its precise rotation and position.

In operation the object may be printed in multicolor and with precise registration, since the rack and pinion assembly assures that each movement of the screen over the rotating object will coincide exactly with every other such movement. In this manner the screen will initially contact a given object for each stroke or color in exactly the identical point on the object to be printed, provided an indexing mark or notch is present on the object and properly aligned in an orientation-specific manner.

Upon a consideration of the foregoing, it will become obvious to those skilled in the art that various modifications may be made without departing from the invention embodied herein. Therefore, only such limitations should be imposed as are indicated by the spirit and scope of the appended claims.

I claim:

1. A printing press for printing on elongated articles, said printing press comprising primary support shafts, a squeegee assembly, a screen assembly, said shafts supporting said screen assembly for lateral and vertical movement and said squeegee assembly for vertical movement, a workholder for securing an elongated cylindrical article to be printed on, the article being mountable on said workholder for rotation about a longitudinal axis, said longitudinal axis being fixedly held by said workholder parallel to said shafts for presentation of a circumferential surface of said article to said screen assembly in a print mode, said screen assembly being movable in a direction perpendicular to said shafts over said article by a drive means, and immovable in a direction parallel to said shafts, said drive means comprising a drive carriage reciprocally movable on a stationary shaft, a screen drive shaft means connected by a pivotal connection at a first end portion to said drive carriage and a means for adjustably securing a second end portion of said screen drive shaft means to said drive carriage with said first end portion closer to said drive carriage than said second end portion, said screen assembly being connected to said screen drive shaft means by sliding means for free reciprocal movement of said screen drive shaft means parallel to said stationary shaft, said screen assembly thereby being reciprocally movable toward and away from said stationary shaft in its following movement on said sliding means.

2. The printing press of claim 1 wherein said workholder supports said article to be printed on at least two spaced pairs of rollers, said article being longitudinally registrable for printing between a first clamping head and a second clamping head, said first clamping head being adjustable to a desired fixed position, said second clamping head being incrementally adjustable in position for confining said article between said first and second clamping heads with minimal play and minimal friction, thereby registering said article for printing while allowing substantially free rotation of said article.

3. The printing press of claim 1 further including a registration means mounted on said screen assembly for assuring proper registration of said elongated articles in multicolor printing.

4. The printing press of claim 3 wherein said registration means includes a rack and pinion assembly, a rack being mounted to an underside of said screen assembly for following reciprocal movement, a pinion gear being engaged with said rack and mounted for stationary rotation about a central axis, an article-engaging shaft being attached to said pinion gear for following rotation, said article-engaging shaft being releasably securable to said article for assuring precise registration in the printing stroke for multicolor printing.

5. A printing press for printing on elongated articles, said printing press comprising primary support shafts, a squeegee assembly, a screen assembly, said shafts supporting said screen assembly for lateral and vertical movement and said squeegee assembly for vertical movement, a workholder for securing an elongated cylindrical articles to be printed on, the article being mountable on said workholder for rotation about a longitudinal axis, said longitudinal axis being fixedly held by said workholder parallel to said shafts for presentation of a circumferential surface of said article to said screen assembly in a print mode, said screen assembly being movable in a direction perpendicular to said shafts and over said article by a drive means, and immovable in a direction parallel to said shafts, said drive means comprising a drive carriage reciprocally movable on a stationary shaft, a screen drive means mounted on said drive carriage, said screen drive means comprising at least one rod mounted at an acute angle to said drive carriage, said rod having one end pivotally attached to said drive carriage and an opposing end connected to said drive carriage in an adjustable manner for varying said acute angle, said screen assembly being attached to said rod by a sliding means for free reciprocal movement of said sliding means parallel to said stationary shaft, said screen thereby reciprocally moving toward and away from said stationary shaft in its following movement on said sliding means.

6. The printing press of claim 5 further including a registration means mounted on said screen assembly for assuring proper registration of said elongated articles in multicolor printing.

7. The printing press of claim 6 wherein said registration means includes a rack and pinion assembly, a rack being mounted to an underside of said screen assembly for following reciprocal movement, a pinion gear being engaged with said rack and mounted for stationary rotation about a central axis, an article-holding shaft being attached to said pinion gear for following rotation, said article-holding shaft being releasably securable to said article for assuring precise registration in the printing stroke for multicolor printing.

8. The printing press of claim 5 wherein said sliding means comprise two spaced rods.

* * * * *